US006390171B2

(12) United States Patent
Drifka et al.

(10) Patent No.: US 6,390,171 B2
(45) **Date of Patent: *May 21, 2002**

(54) ROLL-UP OVERHEAD DOOR FOR SANITARY APPLICATIONS

(75) Inventors: Brian Drifka, Pewaukee; Walenty Kalempa, Slinger, both of WI (US)

(73) Assignee: Rytec Corporation, Jackson, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/825,595

(22) Filed: Apr. 4, 2001

Related U.S. Application Data

(63) Continuation of application No. 09/155,006, filed as application No. PCT/US98/15389 on Jul. 24, 1998, now Pat. No. 6,247,517.

(60) Provisional application No. 60/054,149, filed on Jul. 25, 1997.

(51) Int. Cl.[7] ..... E04F 10/02

(52) U.S. Cl. ..... 160/23.1; 160/44; 160/271

(58) Field of Search ..... 160/23.1, 273.1, 160/310, 265, 11, 19, 22, 44, 271, 385, 387

(56) References Cited

U.S. PATENT DOCUMENTS

| | | | | |
|---|---|---|---|---|
| 1,399,812 A | * | 12/1921 | Sorensen | 160/387 |
| 1,813,980 A | * | 7/1931 | Williams | 160/385 |
| 2,325,992 A | | 8/1943 | Wirthman | |
| 4,282,919 A | | 8/1981 | Teno | |
| 4,478,268 A | | 10/1984 | Palmer | |
| 4,655,019 A | | 4/1987 | Rejc | |
| 4,690,195 A | | 9/1987 | Taylor | |
| 4,974,658 A | | 12/1990 | Komatsu et al. | |
| 5,123,474 A | | 6/1992 | Smith | |
| 5,139,074 A | | 8/1992 | Warner | |
| 5,299,617 A | | 4/1994 | Hying et al. | |
| 5,394,924 A | | 3/1995 | Reic | |
| 5,484,007 A | | 1/1996 | Rejc | |
| 5,765,622 A | | 6/1998 | Lichy | |

FOREIGN PATENT DOCUMENTS

| | | |
|---|---|---|
| DE | 3511473 A 1 | 9/1986 |
| DE | 43 08 052 A 1 | 6/1994 |
| DE | 44 11 997 C1 | 6/1995 |
| DE | 296 15 102 U 1 | 2/1997 |
| EP | 0 057 293 A1 | 8/1982 |
| EP | 0 624 705 A1 | 11/1994 |
| EP | 0 737 796 A2 | 10/1996 |
| FR | 2380 400 | 9/1978 |
| FR | 2 588 038 A1 | 4/1987 |
| NL | OCTR001 No. 63898 | 3/1949 |

* cited by examiner

*Primary Examiner*—David M. Purol
(74) *Attorney, Agent, or Firm*—Wallenstein & Wagner, Ltd.

(57) ABSTRACT

A roll-up overhead door assembly which is selectively moved up and down to open and close an opening and which is guided along sides of the opening by columns, the door having an open position, a closed position and a cleaning position. The door includes a drum positioned proximate the top of the opening, a flexible door panel connected to the drum and a drip guard. The door panel is attached to the drum such that when the door assembly is in an open position the door panel is wound around the drum. The drip guard partially surrounds the drum and is positioned and sized to catch residue falling from the drum or door panel overhead. The door panel is sized such that in the closed position the door panel is connected to a point on the drum so that the panel does not significantly overlap the drum. The door further includes columns on opposed sides of the opening and surrounding the guides. Each column comprises a backplate and, respectively, a cover plate removably attached to each backplate wherein one of either the backplate or the cover plate has side wall. The door assembly further includes a drainage trough for collecting moisture falling from the door. The drainage trough has a first end and a second end and is attached to a bottom edge of the door panel, and is configured such that drainage flows toward at least one end of the trough.

7 Claims, 5 Drawing Sheets

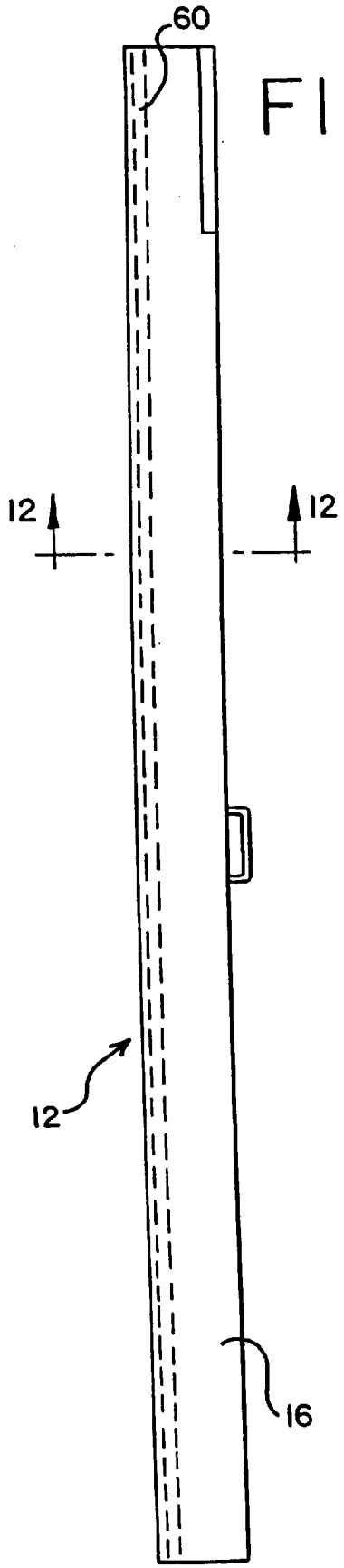
FIG. 11
FIG. 12
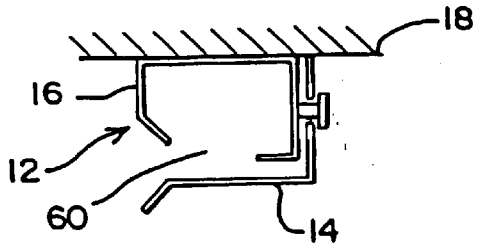
FIG. 13
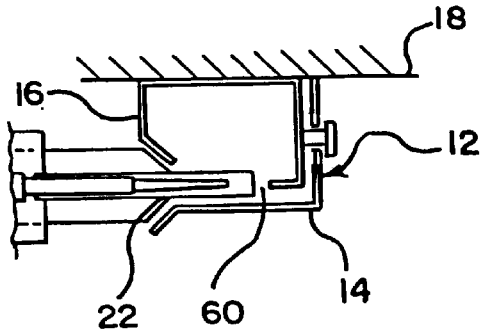

ROLL-UP OVERHEAD DOOR FOR SANITARY APPLICATIONS

RELATED APPLICATIONS

This is a continuation application of U.S. patent application No. 09/155,006 now U.S. Pat. No. 6,247,517 a §371 of International Patent Application No. PCT/US98/15389, filed Jul. 24, 1998 which claims the benefit of U.S. Provisional Application No. 60/054,149, filed Jul. 25, 1997.

TECHNICAL FIELD

The invention relates to industrial doors, and in particular to doors used in conjunction with sanitary, sterile or germfree applications.

BACKGROUND OF THE INVENTION

With the growing public concern over the safety of consumers goods, such as food and pharmaceutical products the government has implemented strict regulations for industries which require sanitary, sterile, or germfree applications. The design of prior roll-up overhead door assemblies for use in such applications have several drawbacks. The most notable drawback of prior designs is the lack of access to the door assembly components for cleaning. For example, access to the door panel and overhead drum for cleaning in prior designs is limited. In addition, prior designs did not allow for removal of the door panel from the drum to completely expose the door panel and drum for cleaning. As a result, mildew and germs would form between the door panel and drum which is not acceptable for sanitary applications.

Prior designs of roll-up overhead doors did not provide for collecting residue, contaminants or food particles which may accumulate on the door panel or drum. As a result when the door assemblies were cleaned the residue, contaminants and food particles would be reintroduced into the immediate work area or atmosphere. Such a design is undesirable for sanitary applications.

Side columns used to guide roll-up overhead doors up and down to open and close an opening provide areas where moisture and contaminants may collect allowing germs and mildew to prosper. Access to these areas for cleaning is restricted in prior designs. The present invention provides a roll-up overhead door for sanitary applications which solves these and other problems.

SUMMARY OF THE INVENTION

The present invention provides a roll-up overhead door assembly which is selectively moved up and down to open and close an opening and which is guided along a channel in side columns at opposed edges of the opening, the door having an open position, a closed position and a cleaning position.

According to one aspect of the present invention, a door is provided which has a drum positioned proximate the top of the opening, a flexible door panel connected to the drum and a drip guard. The door panel is connected to the drum such that when the door assembly is in an open position the door panel is wound around the drum. The drip guard partially surrounds the drum and is positioned and sized to catch residue falling from the drum or door panel.

According to another aspect of the present invention, a door is provided which has a drum positioned proximate the top of the opening and a flexible door panel connected to the drum. The door panel is connected to the drum such that when the door assembly is in the open position the door panel is wound around the drum. The door panel is further sized such that when the door assembly is in the closed position the door panel is connected to a point on the drum so that the door panel does not significantly overlap the drum, thereby exposing the drum and the door panel for cleaning.

According to another aspect of the present invention, a door is provided which has a drum positioned proximate the top of the opening and a flexible door panel connected to the drum. The door panel is connected to the drum such that when the door assembly is in an open position the door panel is wound around the drum; when the door assembly is in the closed position the point at which the door panel is connected to the drum forms a first angle $\alpha$ with an axis, A, which is perpendicular to and extends through the opening; and when the door assembly is in the cleaning position the point at which the door panel is connected to the drum forms a second angle $\beta$ to the axis A, the second angle $\beta$ being greater than the first angle $\alpha$.

According to yet another aspect of the present invention, a door assembly is provided which has a drum positioned proximate the top of the opening, a flexible door panel connected to the drum and columns for guiding the door assembly up and down. The columns are positioned on opposed sides of the opening. Each of the side columns has a backplate and a cover plate removably attached to the backplate, respectively. The backplate and cover plate cooperate to form channels for guiding the door assembly up and down. The cover plate can be removed from the backplate to expose the edges of the door panel and the surfaces of the side columns which form the channel for cleaning.

According to yet another aspect of the present invention, a door assembly is provided which has a drum positioned proximate the top of the opening, a flexible door panel connected to the drum and a drainage trough attached to a bottom portion of the door panel for collecting moisture falling from the door panel. The drainage trough is configured such that the collected moisture flows toward at least one end of the trough.

Other features and advantages of the invention will be apparent from the following specification taken in conjunction with the following drawings.

BRIEF DESCRIPTION OF THE DRAWINGS

FIG. 11 is a front view of the side columns according to the present invention;

FIG. 12 is a cross-sectional view of the side columns taken through the line 12—12 of FIG. 11; and FIG. 13 is a cross-sectional view of the side columns taken through the line 12—12 of FIG. 11 including a door panel and breakaway mechanism.

DETAILED DESCRIPTION OF THE PREFERRED EMBODIMENT

Figure 1:
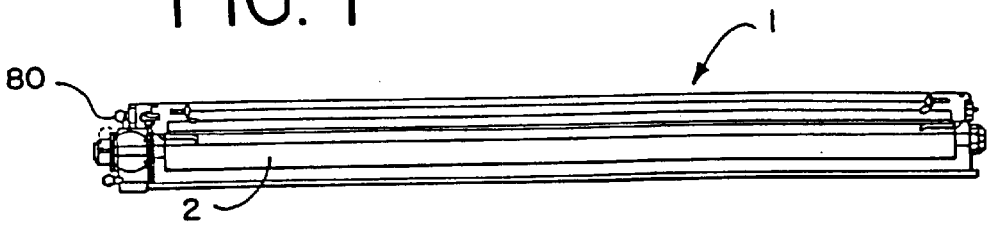
FIG. 1 is a top view of a roll-up overhead door assembly according to the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIGS. 1–13 illustrate a roll-up overhead door assembly 1 according to the present invention. The roll-up overhead door assembly 1 is selectively moved up and down to open and close an opening and is guided along sides of the opening by columns 12. The door assembly 1 has an open position, a closed position and a cleaning position.

Figure 2:
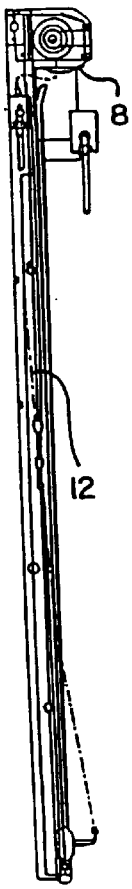
FIG. 2 is a side view of a roll-up overhead door assembly according to the present invention.
Figure 3:
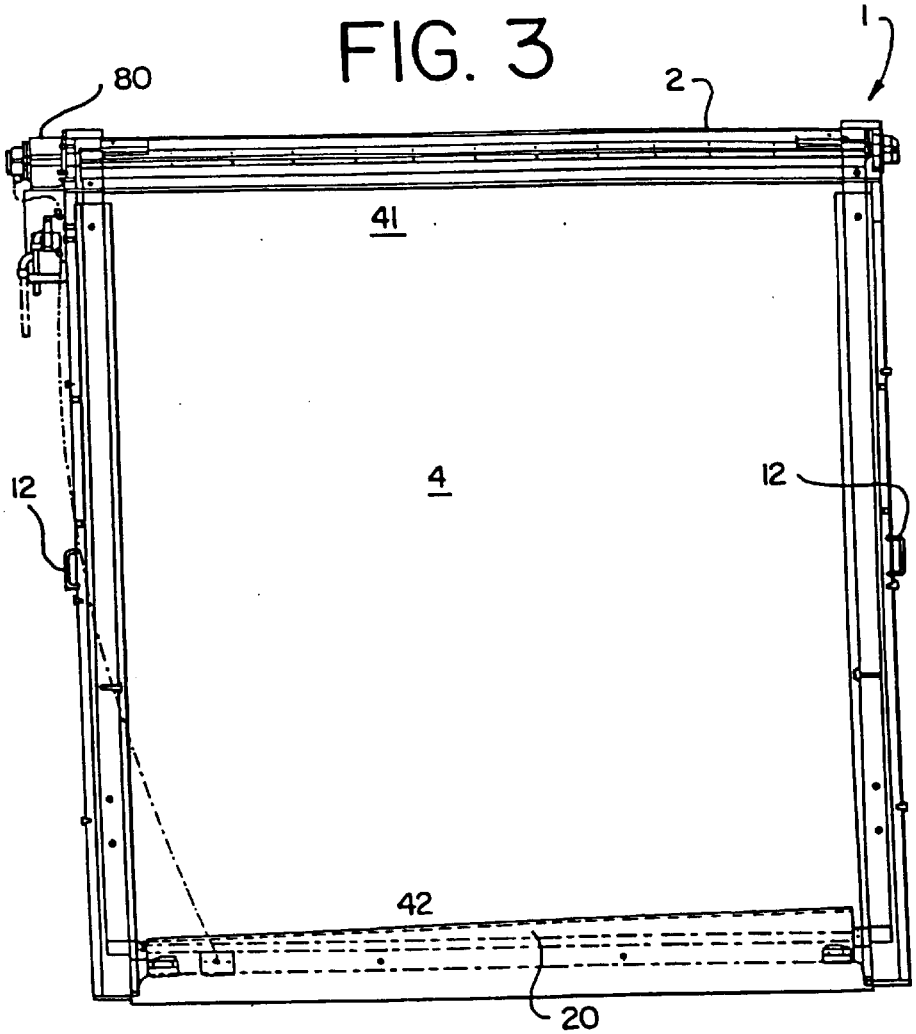
FIG. 3 is a front view of a roll-up overhead door assembly according to the present invention.
Figure 5:
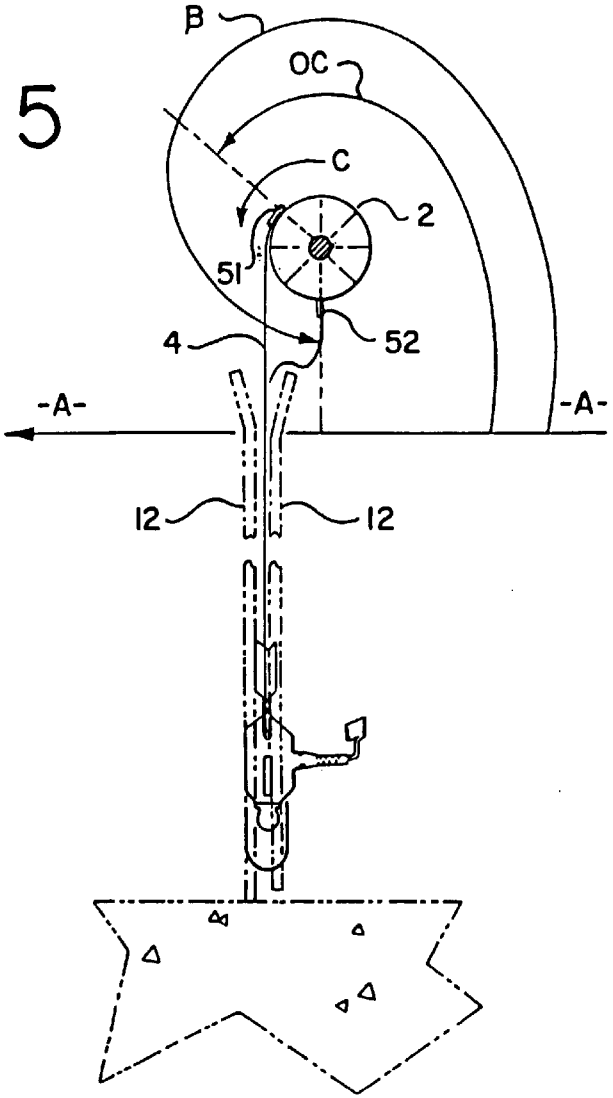
FIG. 5 is schematic side view illustrating an alternative embodiment of the location of the point of attachment of the door panel to the drum for different positions of the door assembly.
Figure 4:
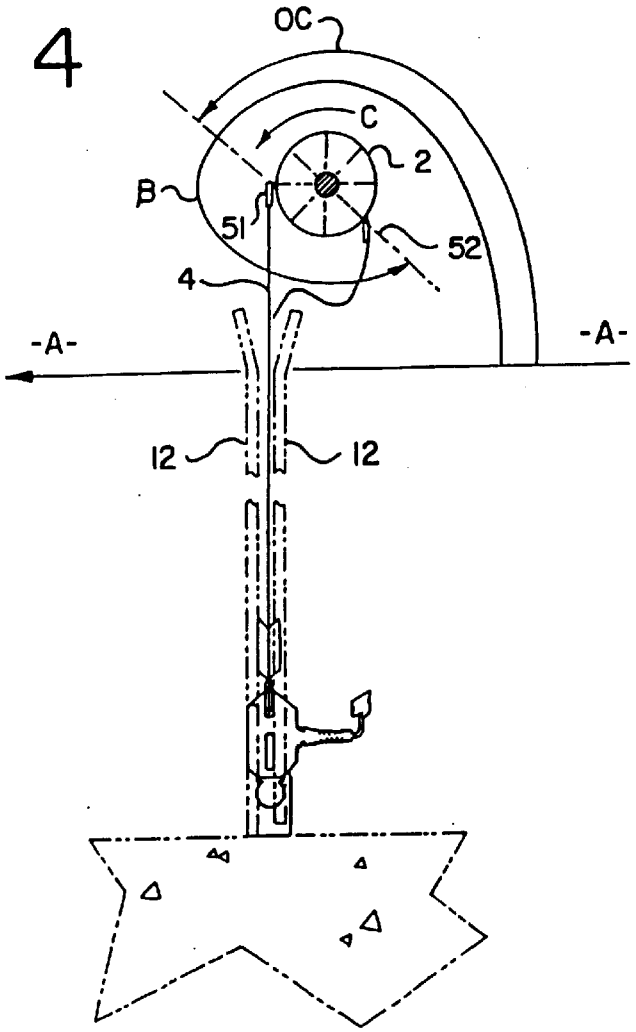
FIG. 4 is schematic side view illustrating the location of the point of attachment of the door panel to the drum for different positions of the door assembly.
Figure 10A:
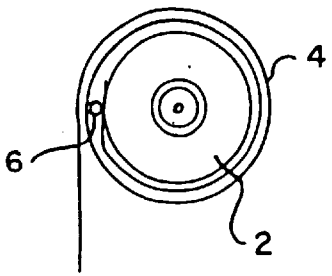
FIG. 10A is a side view illustrating the hinge for attaching the door panel to the drum in the open position.
Figure 10:
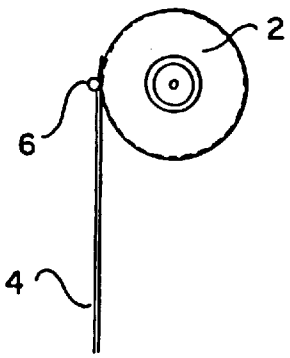
FIG. 10 is a side view illustrating the hinge for attaching the door panel to the drum in the preferred closed position.

As shown in FIGS. 1–3 the door assembly 1 generally includes a drum 2 positioned proximate the top of the opening and a flexible door panel 4 connected to the drum 2 at a top portion 41 of the door panel 4. As illustrated in FIG. 10A, in the open position, the door panel 4 is wound around the drum, covering the entire surface of the drum 2. The door panel 4 is sized such that when the door assembly 1 is in the closed position, the door panel 4 is connected to the drum 2 at a point 51 so that the door panel 4 does not significantly cover the drum 2. This configuration is illustrated in FIGS. 4, 5 and 10. This prevents food particles and residue from becoming trapped between the drum 2 and the door panel 4 and also prevents the buildup of mildew when the door assembly is in the closed position for long periods of time. In the cleaning position 52, the drum 2 is rotated further in the closed direction (shown by the arrow labeled C in FIGS. 4–5) exposing the door panel 4 and the drum 2 and allowing both to be easily cleaned. FIGS. illustrates the door panel 4 as it is attached to the drum 2. Furthermore, the door panel 4 is sized such that when the door assembly 1 is in the cleaning position 52, the door panel 4 projects downwardly from the drum 2, thereby exposing the drum 2 and both sides of the door panel 4.

In the closed position, the door panel 4 is connected to the drum 2 at a point that is located at first angle $\alpha$ with an axis, A, which is perpendicular to and extends through the opening. However, in the cleaning position 52, the drum 2 is further rotated toward in the closed direction (shown by the arrow labeled C in FIGS. 4–5), the door panel 4 projects downwardly from the drum 2, allowing door panel 4 to hang "freely" from the drum 2. In the over rotated closed position, or cleaning position 52, the door panel 4 is connected to the drum 2 at a point that forms a second angle $\beta$ to the axis A. The second angle $\beta$ is greater than the first angle $\alpha$. This allows the entire door panel 4 and the entire surface of the drum 2 to be exposed for easy access and cleaning. In a preferred embodiment the angle $\alpha$ is at a point on the drum 2 such that the door panel projects downwardly from the drum 2 and does not significantly overlap or cover the surface of the drum 2. This configuration prevents the buildup bacteria, mildew or other contaminants from forming on the surface of the drum 2 and on the upper portion 41 of the door panel 4.

Figure 9:
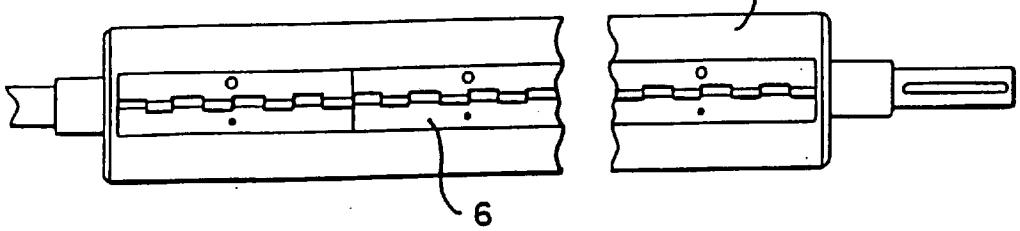
FIG. 9 is a front view of a preferred embodiment of the present invention showing a hinge for attaching the door panel to the drum.

In the preferred embodiment, shown in FIGS. 9 and 10, the door panel 4 is connected to the drum 2 by a hinge 6. One end of the hinge 6 is attached to the drum 2 while the other end of the hinge 6 is attached to the top portion 41 of the door panel 4. In particular, the door panel 4 is connected by a piano hinge 6. However, any connection that allows the door panel 4 to pivot 10 away from the drum 2 when the drum 2 is rotated further in the closed direction, into the cleaning position 52, can be used in the present invention. For example, the door panel may be attached to the drum 2 by fasteners that pivot, industrial glue, or stitching that allows pivoting of the door panel 4 from the drum 2.

Figure 7:
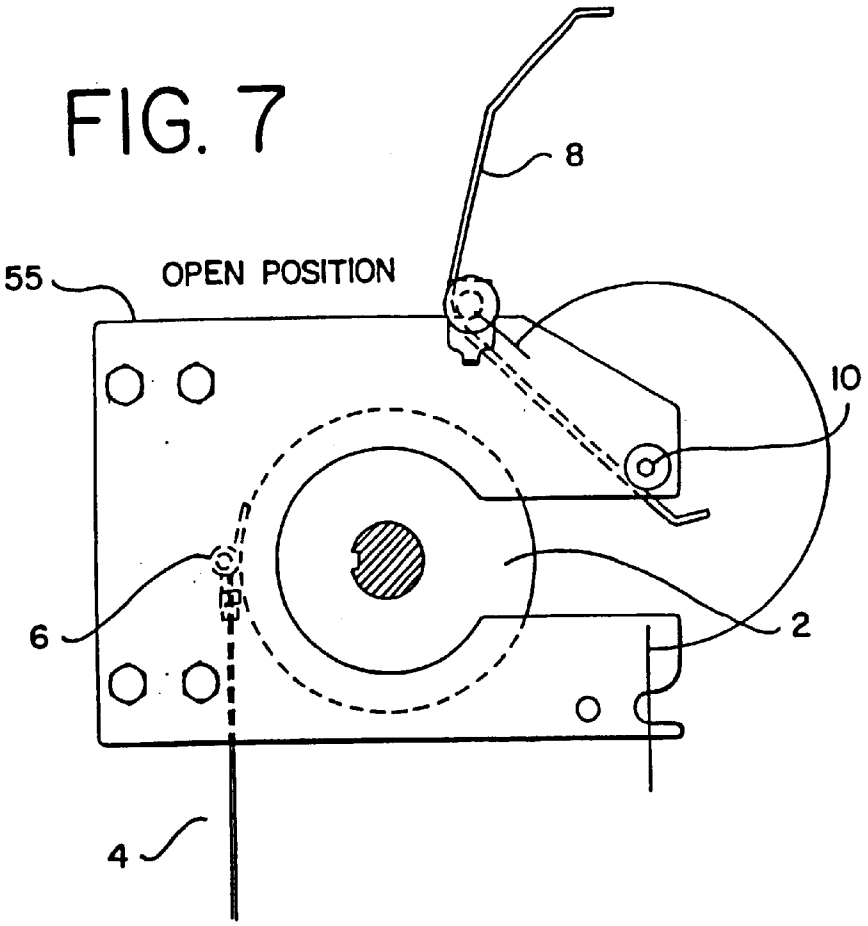
FIG. 7 is a side view of the door assembly of the present invention showing the drip guard in an open position.
Figure 6:
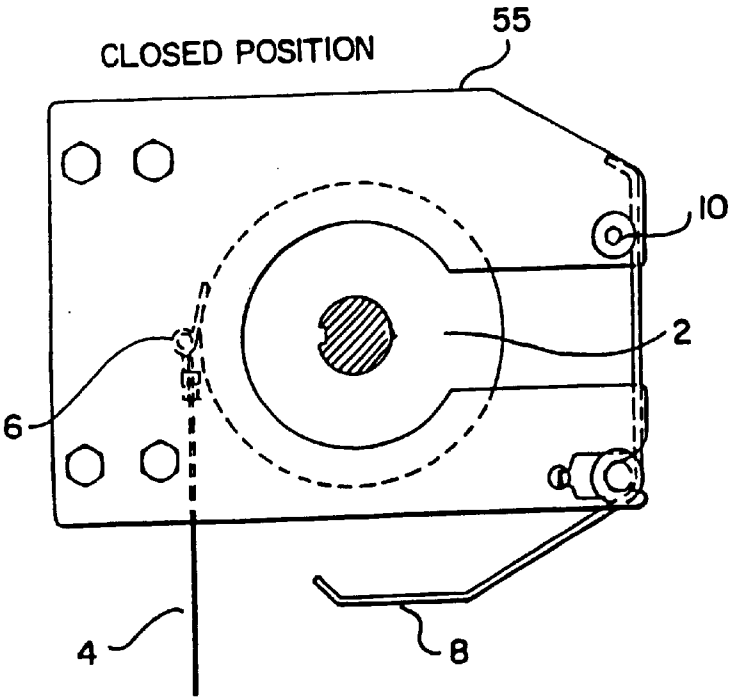
FIG. 6 is a side view of the door assembly of the present invention showing the drip guard in a closed position.

According to one preferred embodiment of the present invention illustrated in FIGS. 6–7, the door assembly 1 further includes a drip guard 8 that is positioned and sized to catch residue falling from the drum 2 or panel overhead. Preferably, the drip guard 8 is connected to mounting brackets 55 which are in turn mounted above the opening. The drip guard is rotatable about a member 10 so that the drip guard 8 may assume an closed position (FIG. 6) and a open position (FIG. 7). When the drip guard 8 is in its closed position, it partially surrounds the drum 2. The drip guard 8 may then be rotated about the member 10 so that the drum 2 and the underside of the drip guard 8 is exposed for cleaning. In an alternative embodiment not shown, the drip guard 8 may be rotated about either end to expose the drum 2 and the underside of the drip guard 8.

As shown in FIGS. 3 and 11–13, the roll-up overhead door assembly 1 also includes columns 12 on opposed sides of the opening. The columns 12 form a channel 60 which acts to guide the assembly, and particularly opposed edges 4*a*, 4*b* of the door panel 4, up and down to open and close the opening. Each column 12 includes a backplate 16 and a cover plate 14. The backplate 16 is attached to a opposed surfaces 18 adjacent the opening, respectively. The cover plate 14 is removably attached to the backplate 16, respectively. The cover plate 14 may be attached by any conventional connecting devices, including snaps, hooks, and interlocking tabs. In a preferred embodiment, the backplate 16 is provided with thumbscrews and the cover plate 14 is provided with corresponding slots or openings which fit over the thumbscrews and then the cover plate 14 is slid into a resting position. As illustrated in FIGS. 12–13, the back plate 16 cooperates with the cover plate 14 to form the channel 60.

In the preferred embodiment, the door assembly 1 further includes a drainage trough 20 for collecting moisture falling from the door. Generally, the trough 20 is attached to a bottom portion 42 of the door panel 4 and has a first end 20*a* and a second end 20*b*. The trough 20 may also be connected to a bottom bar 24 attached to the bottom portion 42 of the door panel 4 and extend upwardly and angularly away from the door panel 4. For example, the drainage trough 20 may be configured such that any collected moisture flows toward at least one end of the trough 20. The drainage may be directed by slanting at least the bottom of the trough 20 downwardly toward one end. Alternatively, at least the bottom of the drainage trough 20 may be steepled so that the drainage is directed to both ends 20*a*, 20*b* of the trough 20. It is also contemplated that the trough 20 assume any other configuration that accommodates the drainage of excess moisture from the door panel 4.

Figure 8:
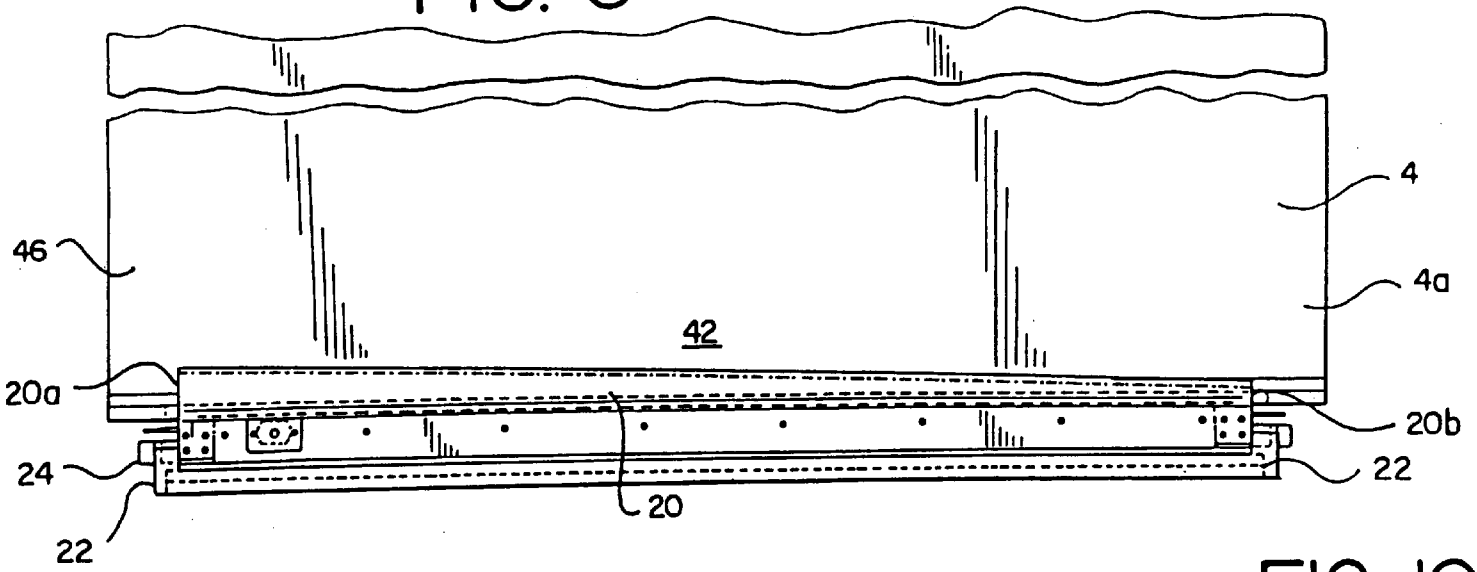
FIG. 8 is a front view of a drainage trough attached to the door panel according to the present invention.

As may be seen in FIG. 8, the door assembly 1 may further include a bottom bar 24 and a breakaway mechanism 22 connected to at least one end of a bottom bar 24. The breakaway mechanism 22 may be any conventional breakaway mechanism 22 currently used with overhead doors. Alternatively, conventional breakaway tabs may be used.

In a preferred embodiment of the present invention, the drum 2 is connected to a motor 80 for rotating the drum 2 between the open, closed and cleaning positions. Preferably, the motor 80 cooperates with an optical encoder for controlling the rotation of the drum 2, and ultimately for controlling the range of the door panel 4 travel. A conventional controller may be used to set automatic limits for the closed, open and cleaning positions. In this regard, a user may select between these predetermined positions and the drum 2 will automatically rotate to the desired position. Accordingly, the user may easily alternate between the closed, open and cleaning positions.

While the specific embodiment has been illustrated and described, numerous modifications come to mind without significantly departing from the spirit of the invention, and the scope of protection is only limited by the scope of the accompanying Claims.

We claim:

1. A roll-up overhead door assembly which is selectively moved up and down to open and close an opening, the assembly having an open position, a closed position and a predetermined cleaning position, the assembly comprising:

a drum positioned proximate the top of the opening and being rotatable between the open position, closed position and predetermined cleaning position;

a flexible non-segmented unitary door panel which blocks substantially the entire opening when the door assembly is in the closed position; and, a hingeable connector for connecting the door panel to the drum, the hingeable connector being interposed between the panel and the drum, the hingeable connector having a first portion, an opposed second portion and an intermediate pivot point disposed between the first and second portions, the second portion of the hingeable connector being pivotable at the intermediate pivot point relative to the first portion of the hingeable connector, the panel being attached to the first portion of the hingeable connector and the drum being attached to the second portion of the hingeable connector, wherein when the drum is rotated toward the cleaning position the hingeable connector pivots independent of the rotation of the drum to allow the door panel to pivot away from the drum and wherein when the drum reaches the cleaning position no portion of the panel is in contact with the drum and no portion of the panel is in contact with the second portion of the hingeable connector.

2. The roll-up overhead door assembly of claim 1, wherein the pivotable connector is a hinge.

3. The roll-up overhead door assembly of claim 1 further including a drip guard partially surrounding the drum, the drip guard being positioned and sized to catch residue falling from the drum or the door panel.

4. The roll-up overhead door assembly of claim 3, wherein the drip guard has a first position and a second position, in the first position the drip guard extends below the drum for catching residue falling from the drum or the door panel and in the second position the drip guard is rotated away from the drum, thereby exposing the drum and the door panel for cleaning.

5. The roll-up overhead door assembly of claim 1, wherein the side columns comprise a backplate and a cover plate removably attached to the backplate, respectively, the backplate and cover plate cooperating to form the channel for guiding the door assembly up and down.

6. The roll-up overhead door assembly of claim 1 further including a bottom bar attached to a bottom portion of the door panel, the bottom bar having a breakaway mechanism connected to at least one end of the bottom bar.

7. The roll-up overhead door assembly of claim 1, wherein in the closed position the point at which the door panel is connected to the drum forms a first angle $\alpha$ with an axis, A, which is perpendicular to and extends through the opening, and in the cleaning position the point at which the door panel is connected to the drum forms a second angle $\beta$ to the axis A, the second angle $\beta$ being greater than the first angle $\alpha$.

* * * * *